US005983593A

United States Patent [19]

Carbary et al.

[11] Patent Number: 5,983,593

[45] Date of Patent: Nov. 16, 1999

[54] INSULATING GLASS UNITS CONTAINING INTERMEDIATE PLASTIC FILM AND METHOD OF MANUFACTURE

[75] Inventors: Lawrence Donald Carbary, Seoul, Rep. of Korea; Chris Edward Nowak, Danville, Calif.; William Robert O'Brien, Midland, Mich.; Leslie Joan Waters, Atlanta, Ga.

[73] Assignee: Dow Corning Corporation, Midland, Mass.

[21] Appl. No.: 08/857,714

[22] Filed: May 16, 1997

Related U.S. Application Data

[63] Continuation-in-part of application No. 08/682,059, Jul. 16, 1996, abandoned.

[51] Int. Cl.[6] ..... E06B 3/24; E04C 2/54

[52] U.S. Cl. ..... 52/786.11; 52/172; 52/204.593; 52/786.13; 156/109; 428/34

[58] Field of Search ..... 52/171.3, 172, 52/204.591, 204.593, 786.1, 786.11, 786.13; 156/107, 109, 85; 428/34, 38

[56] References Cited

U.S. PATENT DOCUMENTS

| | | | |
|---|---|---|---|
| 4,335,166 | 6/1982 | Lizardo et al. | 428/34 |
| 4,337,990 | 7/1982 | Fan et al. | 350/1.7 |
| 4,613,530 | 9/1986 | Hood et al. | 428/34 |
| 4,831,799 | 5/1989 | Glover et al. | 52/172 |
| 4,853,264 | 8/1989 | Vincent et al. | 428/34 |
| 4,950,344 | 8/1990 | Glover et al. | 156/109 |
| 5,007,217 | 4/1991 | Glover et al. | 52/172 |
| 5,156,894 | 10/1992 | Hood et al. | 428/34 |
| 5,308,662 | 5/1994 | Woodard et al. | 428/34 |

FOREIGN PATENT DOCUMENTS

| | | | |
|---|---|---|---|
| 2144476 | 3/1985 | United Kingdom | E06B 3/66 |

*Primary Examiner*—Carl D. Friedman
*Assistant Examiner*—Winnie S. Yip
*Attorney, Agent, or Firm*—Roger H. Borrousch; Patricia M. Scaduto

[57] ABSTRACT

Sealed insulating glass units with multiple-pane construction containing an intermediate taut, flexible heat shrunk plastic sheet are made using silicone edge sealant which exhibits a sheet creep of less than 0.018 cm after 500 hours at 71° C. The plastic sheet remains substantially wrinkle free by the use of such silicone edge sealants.

14 Claims, 4 Drawing Sheets

INSULATING GLASS UNITS CONTAINING INTERMEDIATE PLASTIC FILM AND METHOD OF MANUFACTURE

This application is a continuation-in-part of application Ser. No. 08/682,059, filed Jul. 16, 1996, now abandoned.

BACKGROUND OF THE INVENTION

1. Field of the Invention

This invention relates to insulating glass windows and the manufacture thereof.

2. Background Information

Insulating glass units for use in windows or doors commonly comprise two or more parallel glass panes that are separated from one another by spacers along their edges. Various multiple-pane configurations are known in the art. Certain of these configurations have employed sheets of plastic in parallel spaced relation to the glass panes. If a multiple pane glass unit is to be assembled with a plastic sheet held in spaced relationship between two glass panes, the unit may be manufactured by applying a marginal spacer along the edges of one glass pane, the spacer extending away from the plane of the pane, adhering a heat-shrinkable film to the spacer, and then heat-shrinking the film to draw the film taut and flat. The second pane, also provided with a marginal spacer, is then attached, the film becoming sandwiched between the opposed marginal spacers of the two panes. In another embodiment, the film may be grasped by small springs that are held by or form a part of spacers separating the two glass panes from one another. Generally unbreakable mirrors may be formed by adhering a marginal spacer about the periphery of a sheet of plywood or the like, then adhering a heat-shrinkable, silvered plastic film to the spacers, and then heat-shrinking the film so that it becomes taut and flat to provide a mirrored surface.

In each of the described embodiments employing heat-shrinkable plastic film, the film is stretched over spacers held at the edge of a stiff pane or board, and the plastic film is then heated directly, typically by hot air. For multiple-pane glass units in which the plastic film is to be employed as an internal sheet between but spaced from parallel glass panes, the manufacturing methods cited above have been found difficult and time consuming, and require piecemeal construction methods.

Lizardo et al in U.S. Pat. No. 4,335,166, issued Jun. 15, 1982, describe manufacturing multiple-pane insulating glass window units by supporting a flexible, heat-shrinkable plastic sheet between parallel, spaced glass panes which are spaced from one another and from the plastic sheet (film) by means of spacers arranged about the edges of the glass panes. The panes are sealed to one another along their edges by the spacers and by a sealant adhered to edges of the plastic sheet to provide, with the heat-shrinkable plastic sheet, a sealed integral unit. The unit itself is then heated for a sufficient time and at a sufficient temperature to cause the plastic sheet to shrink and to become taut and wrinkle-free. The resulting integral unit upon cooling, requires no further manufacturing steps, and can be directly inserted into an appropriate frame for use as an insulating glass unit.

Further evaluation of the method claimed by Lizardo et al, found that successful construction depended upon the sealant materials used. For example, the edge sealant proposed by Lizardo et al, the two-part, room-temperature-curing resin identified as GE3:204 (manufactured by General Electric Company) may provide the necessary adhesion to hold the glass panes together along with the spacers, but experience finds that the plastic sheet became wrinkled in a short time after a multiple-pane insulating glass unit containing a plastic sheet was made. Although, in addition to GE3204, various silicone sealants may have been tried as edge sealant in making window units with an intermediate plastic sheet, as far as the present inventors know, to no silicone sealant has been satisfactory. Hood et al in U.S. Pat. No. 4,613,530, issued Sep. 23, 1986, teach that the edge sealant should be polyurethane. Although polyurethanes are useful as edge sealants for the kinds of multiple-pane insulating glass units described by Lizardo et al, they can be degraded by exposure to UV radiation if installed without a proper glazing cap to protect the sealant. Woodard et al in U.S. Pat. No. 5,308,662, issued May 3, 1994, describe the pros and cons of the various kinds of edge sealants and propose a mechanical means to overcome the degradation effects of UV radiation. Woodard et al teach that silicone sealants are resistant to light induced cross-linking and hardening which can cause serious failings in other kinds of sealants but are very permeable to water vapor. The organic sealants such as the polyurethanes and polysulfides are damaged by sunlight and thus Woodard et al have invented a construction for using a nonreflective dark tape positioned exactly right to overcome the impact of UV radiation on the edge sealant.

Hood et al in U.S. Pat. No. 5,156,894, issued Oct. 20, 1992, teach that suitable edge sealants for multiple-pane insulating glass units are curable, high modulus, low-creep, low-moisture-vapor-transmitting sealant, such as a polyurethane adhesive, for example the two-component polyurethanes marketed by Bostik, such as Bostik 3180-HM or 3190-HM. Vincent et al in U.S. Pat. No. 4,853,264, issued Aug. 1, 1989, teach that the same kind of edge sealants as Hood et al for use on curved triple-pane glazing in which a plastic sheet is intermediate between two glass panes. Vincent et al teach that the plastic sheet is anchored along the parallel curved edges but is not attached to the other edges and that the plastic sheet heat shrinks in the direction it is anchored.

SUMMARY OF THE INVENTION

It is an object of this invention to provide a multiple-pane insulating glass unit containing a heat shrunk flexible plastic-sheet with a silicone sealant as an edge sealant. It is also an object of this invention to provide a method of manufacturing a multiple-pane insulating glass unit in which a heat shrinkable flexible plastic sheet is made using a silicone sealant composition.

This invention relates to a sealed insulating glass unit comprising at least one flexible, heat shrunk plastic sheet between parallel,. spaced glass panes, each sheet being substantially parallel to but spaced from confronting surfaces of the panes or another plastic sheet and being fixed at its edges with respect to edges of the panes, a silicone edge sealant between adjacent edges of the panes to provide an integral sealed unit, at least two opposing edges of the unit having each plastic sheet embedded into the silicone edge sealant, where said silicone edge sealant exhibits a sheet creep of less than 0.018 cm after 500 hours at 71° C.

This invention also relates to a method of manufacturing a multiple-pane insulating glass unit comprising (a) forming a substantially sealed integral unit comprising supporting at least one flexible, heat-shrinkable plastic sheet between parallel, spaced glass panes, the sheet being substantially parallel to but spaced-from confronting surfaces of the panes and being fixed at its edges with respect to edges of the panes, (b) applying a curable silicone edge sealant composition between adjacent edges of the panes to provide an integral sealed unit and embedding into said curable silicone edge sealant composition at least two opposing edges of each flexible, heat-shrinkable plastic sheet, (c) curing the silicone edge sealant composition, and then (d) heating the unit to cause each plastic sheet to shrink and become taut and wrinkle-free between the panes where said silicone edge sealant exhibits a sheet creep of less than 0.018 cm after 500 hours at 71° C.

BRIEF DESCRIPTION OF THE DRAWINGS

Description of the Figures

Figure 1:
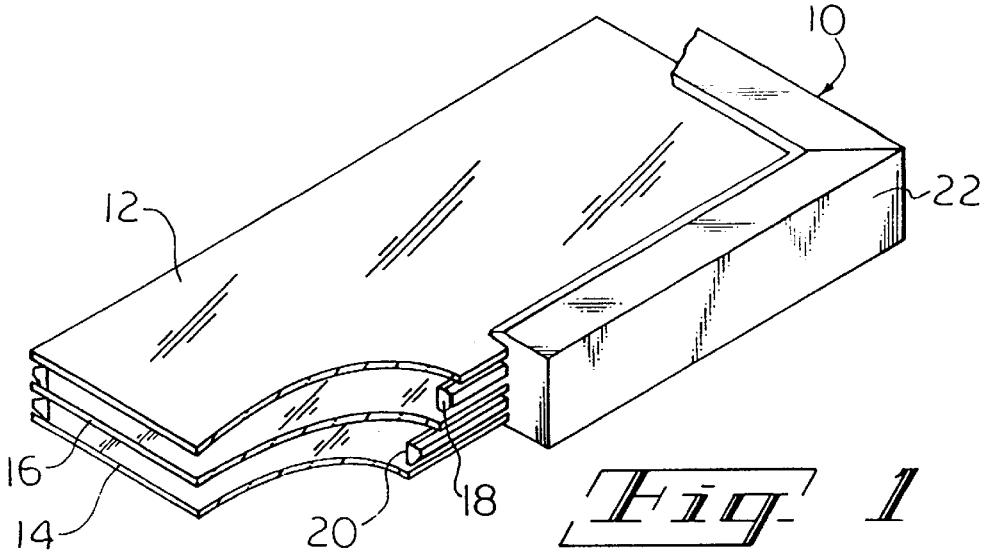

FIG. 1 is a perspective view, partly broken away and in section, of a window unit.

Figure 2:
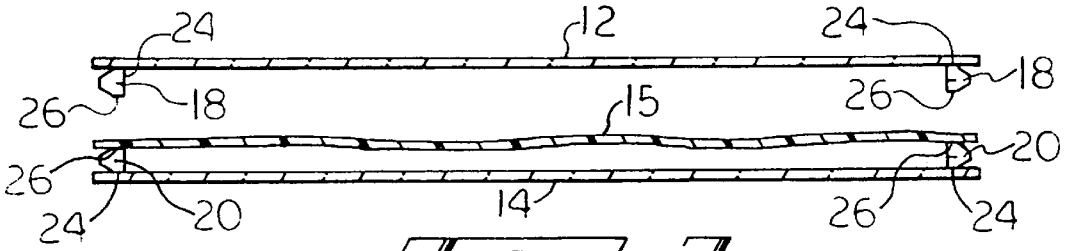

FIG. 2 is an exploded cross-sectional view showing elements of the window unit ready for assembling.

Figure 3:
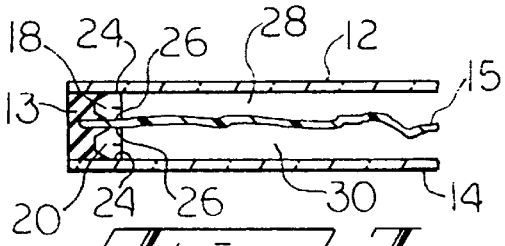

FIG. 3 is a cross-sectional view similar to that of FIG. 2 but showing the window elements assembled.

Figure 4:
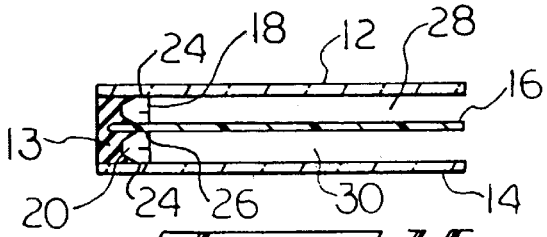

FIG. 4 is a cross-sectional view similar to that of FIG. 3 and showing the window unit after the heating step.

Figure 5:
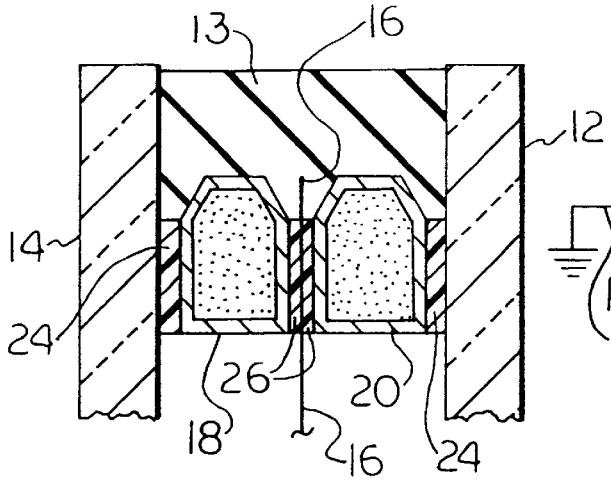

FIG. 5 is a cross-sectional view similar to FIG. 4 but enlarged to show the constructional relationships more clearly.

Figure 6:
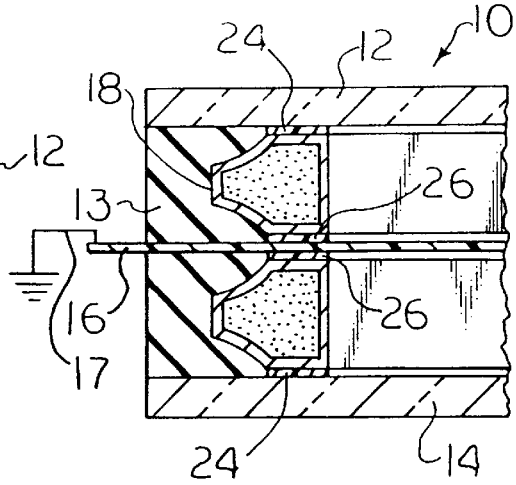

FIG. 6 is an enlarged, fragmentary cross-sectional view of a window unit showing an embodiment in which an electrical lead is electrically coupled to the plastic sheet and ground.

Figure 7:
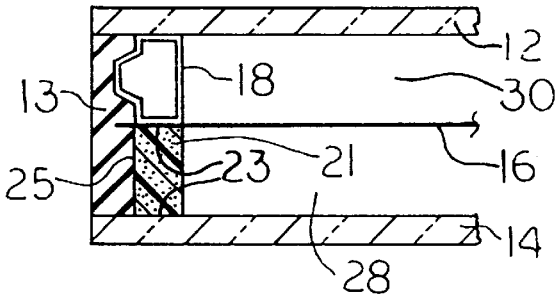
Figure 8:
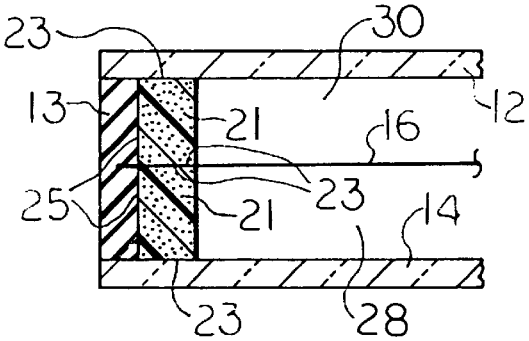

FIG. 7 and FIG. 8 are cross-sections of alternative configurations for single seal, triple glazed sealed units incorporating a plastic inner sheet.

Figure 9:
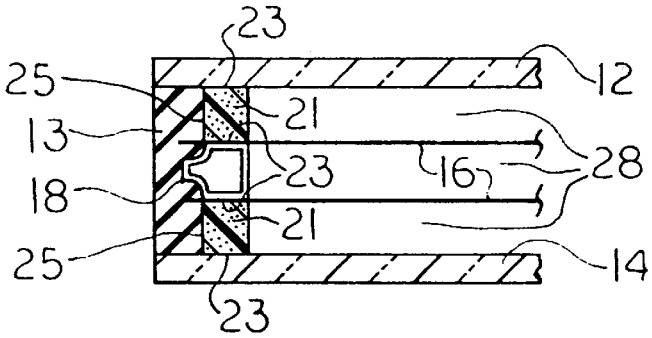

FIG. 9 is a cross-section of a quad glazed window unit incorporating two plastic inner sheets.

Figure 10:
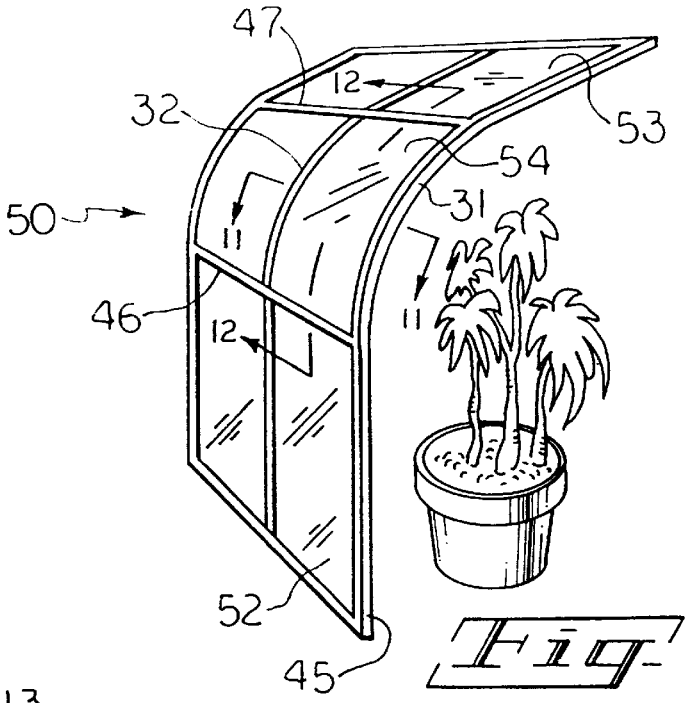

FIG. 10 is a perspective illustration showing a curved glazing structure: in use in a greenhouse.

Figure 11:
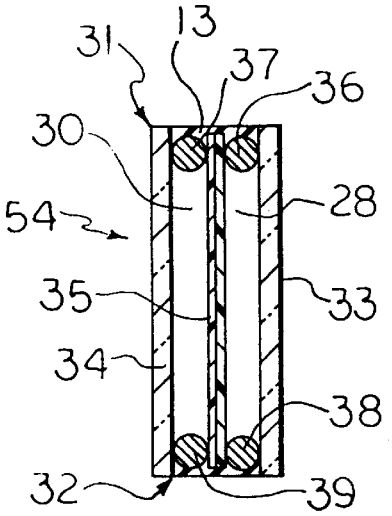

FIG. 11 is a cross-sectional view of a curved glazing structure taken parallel to the straight sides of the structure of FIG. 10.

Figure 12:
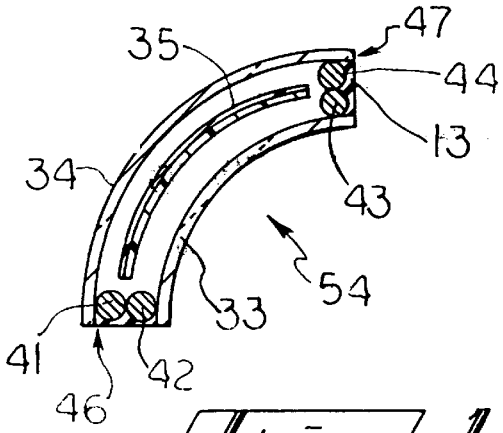

FIG. 12 is a cross-sectional view of a glazing panel taken parallel to the curved side of the structure of FIG. 10.

Figure 13:
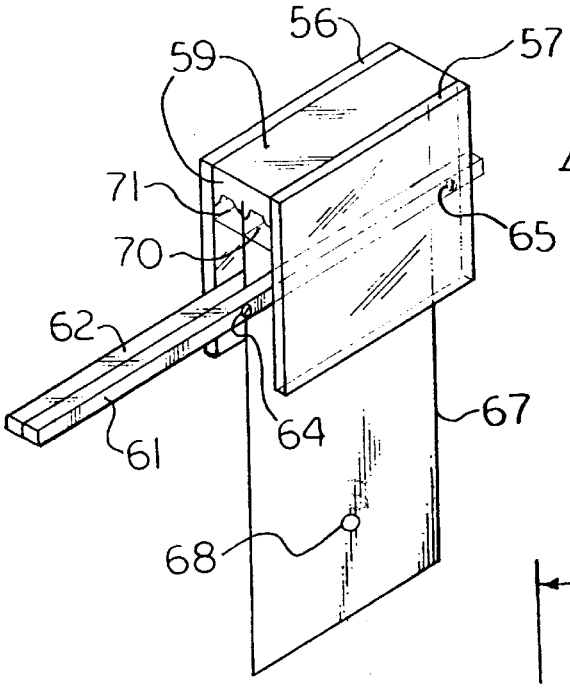

FIG. 13 is a perspective view of the sheet creep test assembly.

Figure 14:
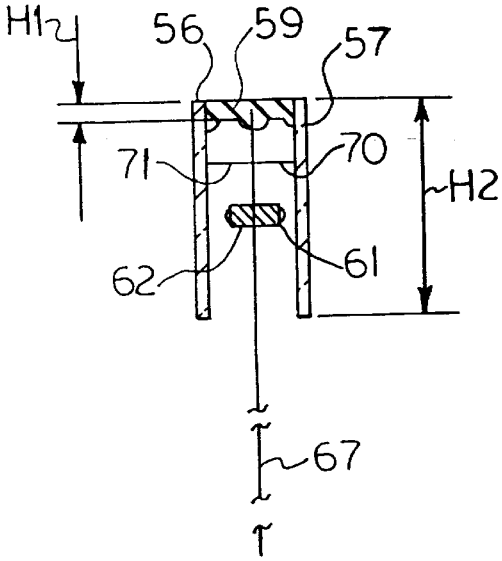

FIG. 14 is a side sectional view of the sheet creep test assembly showing the dimensions.

Figure 15:
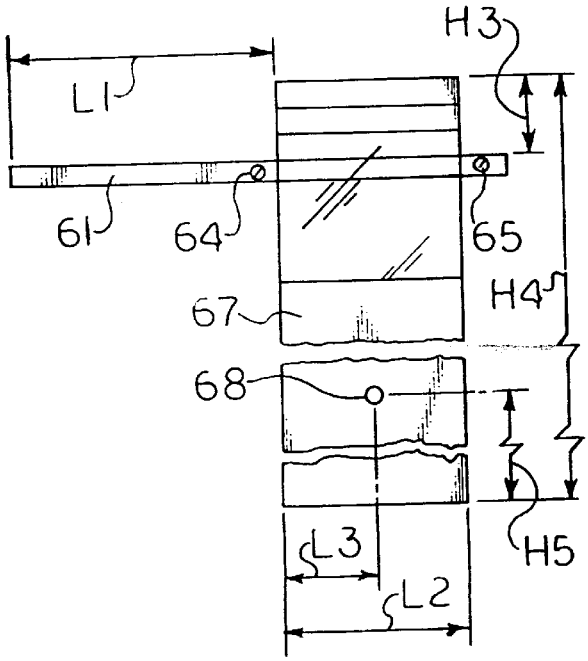

FIG. 15 is a front sectional view of the sheet creep test assembly showing the dimensions.

EXPLANATION OF THE REFERENCE NUMBERS

| | |
|---|---|
| 10 | window unit |
| 12 | spaced glass pane |
| 13 | silicone edge sealant |
| 14 | spaced glass pane |
| 15 | flexible heat shrinkable plastic sheet |
| 16 | taut flexible heat shrunk plastic sheet |
| 17 | electrical lead electrically coupling the plastic sheet to ground |
| 18 | spacer |
| 20 | spacer |
| 21 | foam spacer |
| 22 | outer window frame |
| 23 | pressure sensitive adhesive |
| 24 | gas barrier sealant |

-continued

| | |
|---|---|
| 25 | gas barrier sheet |
| 26 | gas barrier sealant |
| 28 | gas filled space |
| 30 | gas filled space |
| 31 | curved edge |
| 32 | curved edge |
| 33 | curved glass pane |
| 34 | curved glass pane |
| 35 | flexible heat shrunk plastic sheet |
| 36 | spacer |
| 37 | spacer |
| 38 | spacer |
| 39 | spacer |
| 41 | spacer |
| 42 | spacer |
| 43 | spacer |
| 44 | spacer |
| 45 | frame member |
| 46 | straight edge |
| 47 | straight edge |
| 50 | greenhouse structure |
| 52 | flat wall window unit |
| 53 | flat roof window unit |
| 54 | curved window unit |
| 56 | clear float glass panel |
| 57 | clear float glass panel |
| 59 | test edge sealant |
| 61 | aluminum bar |
| 62 | aluminum bar |
| 64 | screw and nut fastener to clamp |
| 65 | screw and nut fastener to clamp |
| 67 | aluminum foil |
| 68 | hole for hanging weights |
| 70 | spacer |
| 71 | spacer |
| H1 | 0.33 cm height |
| H2 | 5.08 cm height |
| H3 | 2.235 cm height |
| H4 | 15.57 cm height |
| H5 | 6.35 cm height |
| D | 0.356 cm diameter |
| L1 | 7.09 cm length |
| L2 | 5.08 cm length |
| L3 | 2.54 cm ± 0.038 cm |

DETAILED DESCRIPTION OF THE PREFERRED EMBODIMENTS

The present discovery that certain kinds of silicone sealants used as an edge sealant 13 in multiple-pane window units 10 having at least one internal taut, flexible, heat-shrunk plastic sheet 16, provides the plastic sheet wrinkle-free for longer time periods than the previously known silicone sealants. Also, the edge sealant 13 exhibits UV stability for longer time periods than polyurethanes and polysulfides. It was discovered that window units 10 made using silicone edge sealants 13 which had a sheet creep of less than 0.018 cm after 500 hours at 71° C., preferably less than 0.018 cm after 1,000 hours at 71° C., maintained the heat shrunk plastic sheet in the taut condition and wrinkle-free whereas those silicone sealants which had a sheet creep of greater than 0.018 cm after 500 hours at 71° C. failed by exhibiting wrinkling of the plastic sheet and the resulting optical distortions produced by wrinkles or waves were unacceptable to the end user. Although the applicants do not wish to be bound by the following theory, they believe that those silicone sealants which result in sheet creep less than 0.018 cm after 500 hours at 71° C. are those which do not contain one or more ingredients which are present in sufficient quantities singly or collectively to increase the sheet creep after 500 hours at 71° C. to greater than 0.018 cm. It is thought that such ingredients are active after the sealant is cured either during the heat shrink step or during the life of the window unit causing the sealant to change properties resulting in unacceptable distortions in the plastic sheet. Some silicone sealants which exhibit a sheet creep of greater than 0.018 cm after 500 hours at 71° C. were found to contain plasticizer or a bond rearranging ingredient which remained active after the sealant has cured or contained both plasticizer and a bond rearranging ingredient. The taut, flexible, heat shrunk plastic sheet 16 is embedded in the silicone edge sealant 13 which anchors the plastic sheet. If the silicone edge sealant allows the anchored portion of the plastic sheet 16, which is under a tension, to relax, wrinkling begins to occur. Because optical properties are very sensitive to any distortion, even slight wrinkling or waves result in unacceptable windows.

Silicone sealant compositions curable under ambient conditions, such as in atmospheric air at room temperature, have now been found where they are capable of meeting the low sheet creep requirements of less than 0.018 cm after 500 hours at 71° C. In particular, these silicone sealants are known as one-package or two-package room temperature vulcanizable (RTV) silicone sealant compositions void of ingredients which cause the sheet creep to increase-to greater than 0.018 cm after 500 hours at 71° C. Two-package RTV silicone sealant compositions can be used to provide faster curing products than one-package compositions. It is believed that ingredients which cause such an increase in the sheet creep include plasticizers and siloxane bond rearranging ingredients which remain active after the RTV silicone sealant composition has cured to a sealant. Examples of such silicone sealant compositions useful as edge sealants which exhibit a sheet creep of less than 0.018 cm after 500 hours at 71° C. are: Dow Corning(R) 3-0117 Silicone Insulating Glass Sealant (hereinafter referred to as DC 3-0117) comprising a polysiloxane, calcium carbonate, and methyltrimethoxysilane; Dow Corning(R) 3145 RTV MIL-A-46145 Adhesive/Sealant (hereinafter referred to as DC 3145) comprising a hydroxy-terminated dimethyl siloxane, trimethylated silica, titanium dioxide, and methyltrimethoxysilane; and Dow Corning(R) 995 Silicone Structural Adhesive (hereinafter referred to as DC 995) comprising a polysiloxane, calcium carbonate, and methyltrimethoxysilane. These sealant compositions do not contain plasticizer and they do not contain a siloxane bond rearranging ingredient which remains active after the sealant composition is cured.

When other silicone sealants compositions which do contain plasticizer and/or an ingredient which retains its siloxane bond rearranging activities after the sealant composition cures are used as an edge sealant, they exhibit a sheet creep of greater than 0.018 cm after 500 hours at 71° C. Such products include silicone sealant compositions illustrated by Dow Corning (R) 982 Silicone Insulating Glass Sealant (hereinafter referred to as DC 982) comprising a two-package product including a base and curing agent where the mixed composition comprises a hydroxy-terminated dimethyl siloxane, calcium carbonate, tetrapropyl orthosilicate, gamma-aminopropyltriethoxysilane, carbon black, polydimethyisiloxane, and dibutyltin dilaurate where the polydimethylsiloxane acts as a plasticizer and the dibutyltin dilaurate acts as a siloxane bond rearranger in the cured sealant; and Dow Corning(R) 795 Silicone Building Sealant (hereinafter referred to as DC 795) which is a one-package product comprising hydroxy-terminated dimethyl siloxane, calcium carbonate, amorphous silica, methyltrimethoxysilane, and polydimethylsiloxane where the polydimethylsiloxane acts as a plasticizer. Both Dow Corning(R) 982 Silicone Insulating Glass Sealant and Dow Corning(R) 795 Silicone Building Sealant exhibit sheet creep of greater than 0.018 cm after 500 hours at 71° C. Other silicone sealants which exhibit sheet creep of greater than 0.018 cm after 500 hours at 71° C. include a one-package silicone sealant product known as General Electric Silicone SCS 2501 and a two-package silicone sealant product from General Electric Company known as GE3204.

DC 3-0117, DC 3145, and DC 995 used as a silicone edge sealant 13 exhibit sheet creep of less than 0.018 cm after 1,000 hours at 71° C. whereas those silicone sealants which failed and exhibited wrinkling of plastic sheet 16 exhibited sheet creep of more than 20 time greater after 500 hours at 71° C.

The methods of making window units and the construction of windows for the embodiments of this invention are similar to those which are described in the prior art. The principle differences are using a silicone sealant composition to produce edge sealant 13 where the resulting cured silicone sealant exhibits a sheet creep of less than 0.018 cm after 500 hours at 71° C. A silicone edge sealant is easily penetrated by water vapor, and thus there is a requirement to provide a means to prevent egress of gas used in the gas filled spaces 28 and 30, and also to prevent the ingress of water vapor into the gas filled spaces 28 and 30. One means to prevent the egress of the gas and the ingress of the water vapor is the use of gas barrier materials illustrated as gas barrier sealant 24 and 26 or gas barrier sheet 25,. The phrase "gas barrier sealant" means that neither water vapor or inert gases pass through the sealant in any substantial amount which would substantially alter the functioning of the resulting window construction for the expected lifetime.

FIG. 1 shows a completed window unit 10 resulting from a method of this invention comprising at least a pair of parallel, spaced glass panes 12 and 14 and an intermediate flexible, heat shrunk plastic sheet 16 that is parallel to the glass panes but spaced inwardly from each pane. Although panes 12 and 14 are referred to being glass throughout this description, it is to be understood that the panes may be made of other construction materials such as rigid plastics such as polyacrylic or polycarbonate, however because glass is the most common material for window construction, panes are referred to as glass panes. The panes are provided with opposing spacers 18 and 20, about their peripheral edges, the spacers supporting the panes in their spaced, parallel relationship to plastic sheet 16. Plastic sheet 16 may be coated or tinted as desired to provide desired window effects known in the art. The thickness of plastic sheet 16 in FIG. 1 is slightly exaggerated merely to illustrate the position of the sheet relative to panes 12 and 14. Frame 22 illustrates that insulating glass window units are produced with frames which are well-known in the art and there is no need for further details here.

In the method of manufacturing window units, glass panes 12 and 14 are provided and are cut to the same length and width dimensions. To one surface of each of the panes is adhered a spacer (18 and 20 as shown in FIG. 2), the spacer extending about the periphery of the pane and spaced inwardly from the pane edge, as shown in FIG. 5 which is enlarged for illustrative purposes. Each spacer comprises an elongated shape of aluminum or plastic or other rigid material, the shape desirably having walls so formed as to provide hollow interior and flattened, parallel exterior wall portions. The hollow portion may contain a desiccant, such as a silica gel. The spacer can be adhered, for example, to the surface of the glass pane by a gas barrier sealant (24 and 26) such as polyisobutylene which is capable of withstanding temperatures in the order of 121° C. without substantial deterioration.

A flexible heat shrinkable plastic sheet 15 is drawn across spacers 20 carried by one of the panes and is pulled as taut as practical, as illustrated by FIG. 2, such that sheet 15 comes into contact with a sealant, such as the gas barrier sealant 26, on spacer 20 as shown. The other pane 12, with its peripheral spacer: 18 is oriented with respect to the first pane 14 so that gas barrier sealant 26 on spacer 18 is opposite to spacer 20 and in direct opposed relationship, plastic sheet 15 being captured between the opposing sealants 26. The plastic sheet 15, being flexible, ordinarily contains waves and wrinkles at this stage, as shown diagramatically and in exaggerated form in FIG. 3. Edge sealant 13 is then applied between the edges of the glass panes which extend outwardly of the spacers 18 and 20, such edges forming, with the spacers, a slight depression or trough in the edge of the assembled unit. The edges of plastic sheet 15 extend into the depression as shown in FIG. 3 and FIG. 5. The silicone edge sealant is then cured in place to adhere the glass panes together strongly enough to allow movement of the units. The glass panes, the outwardly exposed portions of the spacers, and the edges of the plastic sheet form an integral unit.

Plastic sheet 15 is preferably oriented midway between the surfaces of confronting glass pane 12 and 14. It is understood that the plastic sheet, when shrunk, exerts inwardly directed forces on the spacers which in turn cause compressive forces to be exerted on, and in the plane of, the glass panes. By having the plastic sheet midway between the confronting glass pane surfaces, the compressive load borne by each pane, although slight, is expected to be approximately equal.

The integral unit is then heated, such as by placing it into a forced air oven, for a period sufficient to cause the heat shrinkable plastic sheet to shrink to the extent necessary to remove substantially all wrinkles or waves in the sheet. The sheet is held at its edges by spacers 18 and 20 and silicone edge sealant 13. Edge. sealant 13 should resist softening during the heating step to heat shrink the plastic sheet, it should not deteriorate during the heating step, and the sealant should anchor the edges of the sheet and not allow movement of the sheet with respect to the panes. The silicone edge sealant should hold the plastic sheet in position and not relax either during the heating step or thereafter. Such relaxation or sheet creep can result in wrinkles or waves which produce undesirable optical distortions. It is important to equalize the gas pressure between gas filled spaces 28 and 30. This equalization may be accomplished by providing one or more perforations in the plastic sheet. FIG. 4 illustrates a window unit 10 after the heating step and the heat shrunk plastic sheet 16 in its taut condition. FIG. 5 illustrates in an enlarged view the positioning of the taut heat shrunk plastic sheet 16 with respect to the glass panes 12 and 14, the gas barrier sealant 24 and 26, the spacers, and edge sealant 13.

Flexible heat shrinkable plastic sheets are known in the art and are available commercially. Such sheets can be produced by stretching the sheets in their length and width dimensions at temperatures below their melting point to provide molecular orientation in the sheets. Subsequently heating the sheets reduces the molecular orientation causing the sheets to shrink in length and width dimensions. One preferred plastic for making sheets is a polyester known as polyethylene terephthalate. Common temperatures for causing such materials to shrink are in the range of 90° C. to 121° C. Plastic sheets 15 preferably have thicknesses of from about 0.01 to 0.5 mm. The plastic sheets can be coated or tinted with dye to provide desirable or pleasing effects. The sheets can be coated on one or both sides with coatings which are highly transmissive of visible light but highly reflective of long wave infrared radiation. For additional details regarding the window construction and the method of manufacturing the window units which contain an intermediate plastic sheet, consult U.S. Pat. No. 4,335,166, which is hereby incorporated by reference for this purpose.

In buildings or enclosures, it is desirable to provide windows and doors which will allow natural light to enter the building or enclosure which is to be shielded from electromagnetic radiation, such as microwave radiation, yet the window units should be heat insulating while being transparent to visible light. Such buildings or enclosures might be used for housing digital computers or sensitive electronic equipment which could be adversely affected by high or low level radiation in the range from kilohetz frequencies to gigahertz frequencies. There also exists a security basis in many government and military buildings for shielding the interiors thereof to prevent electronic eavesdropping. The ability to remotely access information through electronic monitoring can be significantly reduced by the use of electronic shielding techniques when combined with properly designed shielded walls, roofs, and floors. Hood et al in U.S. Pat. No. 4,613,530 which is hereby incorporated by reference to show window unit containing a heat shrunk plastic sheet 16 which is coated with an electrically conductive coating as a transparent thermally insulating sheet which also serves as a shield for electromagnetic radiation. Such electrically conductive heat shrunk plastic sheets can be made with a metallic coating deposited to one or both sides of the sheet. These kinds of coatings can be produced by vacuum deposition of materials which result in an optically transparent film in the 400 to 700 nm range (visible region) but which have electrical conductivity sufficient to attenuate electromagnetic energy in the longer wavelength range, $10^4$ to $10^{10}$ nm radio frequencies. FIG. 6 illustrates the electrically conductive heat shrunk plastic sheet 16 with an electrically conductive lead 17 from the sheet to ground and showing that there is a need to extend the plastic sheet through the edge sealant to make such a connection. For additional details for the manufacture of window units which include the electrically conductive intermediate plastic sheets, consult Hood et al in U.S. Pat. No. 4,613,530.

This invention includes insulating glass units which contain one or more intermediate taut, flexible, heat shrunk plastic sheets and also other kinds of spacers such as illustrated by Glover et al in U.S. Pat. No. 5,007,217, issued Apr. 16, 1991, which is hereby incorporated by reference to show glass units with more than one taut plastic sheet intermediate and to show another kind of spacers and combinations of spacers, and methods of making such glass units. FIG. 7 and FIG. 8 show triple glazed units with an intermediate plastic sheet 16. As illustrated by Glover et al, such plastic sheets can be coated with a low-emmissivity coating, such as a product manufactured by Southwall Technologies, Palo Alto, Calif., and sold under the trade name of Heat Mirror.

FIG. 7 shows a conventional metal T-shaped spacer 18 with a foam spacer 21 which typically contains desiccant. The flexible or semi-rigid foam spacer 21 can be manufactured from thermoplastic or thermosetting plastics. Suitable thermosetting plastics include silicone and polyurethane and suitable thermoplastics include thermoplastic elastomers such as a Santoprene. Preferably, the foam is a silicone because of the advantages it provides, including good durability, minimal outgassing, low compression set, good resilience, high temperature stability, and cold temperature flexibility. Silicone foam is also moisture permeable so that moisture vapor can readily reach the desiccant material within the foam. An assembled metal spacer frame is laid on top of plastic sheet and the sheet is adhered to the spacer with a pressure sensitive adhesive 23. The sheet is then cut to size in the conventional way so that it extends into the groove created by spacer 18. A foam spacer 21 is then laid on top of the plastic sheet in line with spacer 18 below and adhered to the sheet with pressure sensitive adhesive 23. The plastic sheet 15, spacer 18, and foam spacer 21 combination is then sandwiched between panes 12 and 14. The outward facing perimeter is filled with edge sealant 13. This edge sealant composition cures and bonds strongly to the plastic sheet, glass panes, and spacers to hold the unit in position. Plastic sheet 15 is then heat shrunk as described previously herein by exposing the assembled unit to heat by placing it in an air circulating oven thereby producing a taut, flexible heat shrunk plastic sheet 16 intermediate between glass panes 12 and 14. A gas barrier sheet 25 is shown in the unit construction of FIG. 7. FIG. 8 is an alternate construction of a glazed unit similar to the one illustrated by FIG. 7 but where both spacers are foam spacers 21. FIG. 9 shows a quad glazed unit containing two taut, flexible heat shrunk plastic sheets 16 which are adhered to spacer 18 with pressure sensitive adhesive 23. On either side of spacer 18, there is a foam spacer 21 typically containing desiccant and backed with gas barrier sheet 25. This window unit of FIG. 9 is constructed using essentially the same method of manufacturing as described above using foam spacers, except it incorporates an additional plastic sheet 15 and foam spacer 21. The three interconnected gas filled spaces 28 can be filled with a very low heat conductive gas such as krypton. This type of window construction is further illustrated by Glover et al in U.S. Pat. No. 4,831,799, issued May 23, 1989, which is hereby incorporated by reference to show multiple layer insulating glazing units with foam spacers.

Silicone edge sealant 13 of this invention also finds use in constructing curved glazing structures such as described by Vincent et al in U.S. Pat. No. 4,853,264, issued Aug. 1, 1989, which is hereby incorporated by reference to show curved window unit and methods of their manufacture. FIG. 10 shows a greenhouse structure 50 which is an assembled curved glazing structure having a frame member 45, flat wall window unit 52, flat roof window unit 53, curved window unit 54, straight edges 46 and 47, and curved edges 31 and 32. The two curved edges are parallel to one another and the two straight edges are parallel to one another.

FIG. 11 is a cross-section taken along lines 11–11' in FIG. 10 and shows two curved glass panes 33 and 34 and flexible heat shrunk plastic sheet 35. Plastic sheet 35 can have a heat-reflective layer on its outer side, i.e. the side facing out of a building. Glass panes 33 and 34, and plastic sheet 35 are spaced apart from one another by gas filled spaces 28 and 30 by means of spacers 36, 37, 38, and 39. The spacers together with edge sealant 13 and gas barrier sealant grip and adhere plastic sheet 35 into the structure along curved edges 31 and 32. In contrast, as shown in FIG. 12, plastic sheet 35 is not affixed to curved glass panes 33 and 34 at the edges parallel to straight sides 46 and 47. At these edges, spacers 41, 42, 43, and 44 serve to join glass panes 33 and 34. The spacers 36, 37, 38, 39, 41, 42, 43, and 44 are illustrated as individual components, but in actual practice can be assembled into cured rectangular open frames. Typical spacer materials are plastic extrudates and aluminum and steel extruded and roll-formed channels, such as those described by Lazardo et al. and Vincent et al. These spacers can be of any cross-section and the distorted circles shown in FIG. 11 and FIG. 12 are merely representational and are generally rectangular or square cross-sections. To achieve a good parallel relationship among the two glass panes and the intermediate plastic sheet, the heat-shrinkable plastic sheet should shrink preferentially perpendicular to the curved edges to which the plastic sheet is attached. For example, using a 0.0254 cm polyester as the plastic sheet and heating at 93° C. to 104° C., it is possible to obtain an overall shrinkage in the range of 0.4–0.5% in one direction and a shrinkage in the range of only 0.1–0.2% in the other direction. Such plastic sheets should be oriented with the high-shrink direction being between the two curved edges. In fabricating such window units, one can use plastic sheet coated with a dielectric metal dielectric interference filter or a heat or light-reflecting layers, such as described in Fan et al, U.S. Pat. No. 4,337,990, issued Jul. 6, 1982 which is hereby incorporated by reference to show plastic sheets containing coatings for various purposes.

Edge sealant 13 as described herein in a variety of window constructions containing intermediate taut, flexible heat-shrunk plastic sheets gives to these window constructions longevity of these plastic sheets not previously observed with the sealants used as edge sealants. The utility of heat-shrunk plastic sheets depends upon its maintaining its taut condition over the expected life of the window construction without allowing the formation of waves or wrinkles which create optical or reflective distortions. It is the use of silicone edge sealant 13 which provides these advantages of the window units and in the methods of manufacturing a variety of constructions.

The following examples are illustrative of the present invention and should not be construed as limiting the present invention which is properly delineated in the claims.

EXAMPLE

Silicone edge sealants suitable for the window units of the present invention and in the methods of manufacturing such window units had a sheet creep of less than 0.016 cm after 500 hours at 71° C. The sheet creep was determined by a high temperature sealant creep test which was as follows:

A 5.08 cm H2 by 5.08 cm L2 cross-section of an insulating glass test unit was constructed as illustrated by FIG. 13, FIG. 14, and FIG. 15 where an aluminum strip 67 having a thickness of 0.381 mm was substituted for a plastic sheet. A load of 3.6 kg was applied by hanging weights from hole 68 having a 0.356 cm diameter D for a test period measured in hours at 71° C. ±1° C. A fixed reference point was used to monitor the relative movement due to sealant creep (sheet creep). The amount of creep allowed by the test edge sealant 59 was observed and recorded identifying the load and length of time of the test. FIG. 13 illustrates the positioning of spacers 70 and 71, test edge sealant 59, aluminum bars 61 and 62 which were held in place by screw and nut fasteners 64 and 65 to clamp the aluminum bars to the aluminum sheet 67 to measure the amount of creep. Spacers 70 and 71 were 5.08 cm long and 0.8 cm wide. The glass panes of the test units were 5.08 cm squares of clear float glass with a 0.3 cm thickness. Aluminum sheet 67 was 5.08 cm by 15.24 cm by 0.381 mm. The aluminum bars 61 and 62 were 0.635 cm by 0.635 cm by 7.94 cm.

Each edge sealant composition to be tested was used to prepare insulating glass test units as described by FIG. 13, FIG. 14, and FIG. 15 along with the description provided here. Epoxy resin was used to adhere the spacers to the glass test panes and the aluminum sheet in the construction as identified by the drawings. Within one hour after the epoxy resin was applied, sealant composition, mixed if a two package composition, was applied to complete the glass test unit. Each test unit was cured for at least 21 hours at 21° C. The aluminum bars were attached to the aluminum sheet and secured with the screw and nut fasteners as shown. The glass test unit was then mounted along with a linear displacement measurement device as the reference point. Each edge sealant composition was tested at least three times. Each test unit was placed in a forced-convection oven at 71° C. where the temperature was maintained within 1° C. An oven with a transparent door was used so that the movement of the aluminum bar could be observed without disturbing the test units. It was required that the fixtures for mounting the glass test units in the oven evenly supported the two glass panes in each sample and the aluminum sheet with attached weights did not touch the fixture. The fixtures also kept the glass panes parallel to each other with an allowable deviation from parallel of 0.127 mm maximum. The load on each test unit aluminum sheet acted along the vertical centerline of the sheet. The device used to measure the linear displacement of the aluminum bars had a range of 0 to 2.54 cm with marked increments of 0.025 mm minimum. Each creep test was started within 72 hours of the application of the edge sealant composition. The test units were placed in the test oven, load (weights) was placed on the aluminum sheet being careful to avoid impact loading. The measuring device was zeroed between 2 and 5 minutes after loading the weights. Creep data was recorded daily recording the hours from zeroing the measuring device were observed along with the displacement, sheet creep. Each edge sealant composition was at least tested three times and the average was recorded as shown in the Table. Sheet creep of less than 0.018 cm after 500 hours at 71° C. was considered to be acceptable for silicone edge sealants. Also, extrapolating the data out to 10 years by observing the rate of change, was considered to have acceptable sheet creep if such an extrapolation was found to be less than 0.018 cm at the 10 year time.

The sealant compositions tested for sheet creep were as follows: DC 3-0117, DC 3145, DC 995, DC 982, DC 795, General Electric Silicone CSC 2501, Bostik 3180-HM, Novaguard 470, and GE3204. The values for the resulting sheet creep were as shown in the Table, except it was observed that GE3204 resulted in wrinkling of a taut heat shrunk plastic sheet in a relative short time.

TABLE

| HOURS | DC 3-0117 | DC 3145 | DC 995 | DC 982(1) | DC 795(1) | BOSTIK 3180-HM(1) | NOVAGUARD 470(1) | GE2501(1) |
|---|---|---|---|---|---|---|---|---|
| 24 | 0 | 0.0015 | 0.002 | 0.009 | 0.009 | 0.009 | — | >0.018(2) |
| 288 | — | — | — | — | — | 0.031 | — | — |
| 336 | 0 | 0.001(5) | 0.0025(4) | 0.024 | 0.018(3) | — | >0.018(2) | — |
| 504 | 0.0013 | — | — | 0.028 | — | — | — | — |
| 1008 | — | — | — | — | — | 0.036 | — | — |
| 1030 | 0.0025 | — | — | 0.038 | — | — | — | — |
| 1872 | — | — | — | — | — | 0.039 | — | — |
| 2031 | 0.0025 | — | — | 0.050 | — | — | — | — |

(1) edge sealant composition used for comparative purposes
(2) test stopped
(3) rate of sheet creep increasing at approximately same rate as DC 982
(4) no observable change in rate of sheet creep increase from 48–336 hours
(5) decrease observed in sheet creep from first 24 hours That which is claimed is:

1. A sealed insulating glass unit comprising at least one flexible, heat shrunk plastic sheet between parallel, spaced glass panes, each sheet being substantially parallel to but spaced from confronting surfaces of the panes or another plastic sheet and being fixed at its edges with respect to edges of the panes, a silicone edge sealant between adjacent edges of the panes to provide an integral sealed unit, at least two opposing edges of the unit having each plastic sheet embedded into the silicone edge sealant, where said silicone edge sealant exhibits a sheet creep of less than 0.018 cm after 500 hours at 71° C.

2. The sealed insulating glass unit in accordance with claim 1 in which the silicone edge sealant is a room temperature vulcanizable silicone sealant composition.

3. The sealed insulating glass unit in accordance with claim 2 in which the room temperature vulcanizable silicone sealant composition is void of at least one ingredient selected from the group consisting of a plasticizer and a bond rearranging ingredient which remains active after the silicone sealant has cured.

4. The sealed insulating glass unit in accordance with claim 1 in which the silicone edge sealant exhibits a sheet creep of less than 0.018 cm after 1000 hours at 71° C.

5. The sealed insulating glass unit in accordance with claim 4 in which the silicone edge sealant is a room temperature vulcanizable composition.

6. The sealed insulating glass unit in accordance with claim 5 in which the room temperature vulcanizable silicone edge sealant composition is void of at least one ingredient selected from the group consisting of a plasticizer and a bond rearranging ingredient which remains active after the silicone sealant has cured.

7. The sealed insulating glass unit in accordance with claim 4 in which-the silicone edge sealant exhibits a sheet creep such that each plastic sheet does not wrinkle or deform causing optical distortions during usage.

8. The sealed insulating glass unit in accordance with claim 1 in which elongated spacers separate the surfaces of each pane at the periphery of the glass unit, each spacer having a generally flattened continuous surface lying in a plane parallel to but spaced from the surface of the pane to which it is attached by a gas barrier sealant, the spacer attached to one pane being congruent to the spacer attached to the other pane, supporting between the flattened surfaces of the spacers of at least two opposing edges heat shrunk plastic film attached to the spacers but spaced from the surface of each plastic film to which it is attached by a gas impervious sealant.

9. The sealed insulating glass unit in accordance with claim 8 in which the silicone edge sealant is a room temperature vulcanizable silicone sealant composition.

10. The sealed insulating glass unit in accordance with claim 9 in which the room temperature vulcanizable silicone edge sealant composition is void of at least one ingredient selected from the group consisting of a plasticizer and a bond rearranging ingredient which remains active after the silicone sealant has cured.

11. The sealed insulating glass unit in accordance with claim 4 in which elongated spacers separate the surfaces of each pane at the periphery of the glass unit, each spacer having a generally flattened continuous surface lying in a plane parallel to but spaced from the surface of the pane to which it is attached by a gas barrier sealant, the spacer attached to one pane being congruent to the spacer attached to the other pane, supporting between the flattened surfaces of the spacers of at least two opposing edges heat shrunk plastic film attached to the spacers but spaced from the surface of each plastic film to which it is attached by a gas impervious sealant.

12. The sealed insulating glass unit in accordance with claim 7 in which elongated spacers separate the surfaces of each pane at the periphery of the glass unit, each spacer having a generally flattened continuous surface lying in a plane parallel to but spaced from the surface of the pane to which it is attached by a gas barrier sealant, the spacer attached to one pane being congruent to the spacer attached to the other pane, supporting between the flattened surfaces of the spacers of at least two opposing edges heat shrunk plastic film attached to the spacers but spaced from the surface of each plastic film to which it is attached by a gas impervious sealant.

13. The sealed insulating glass unit in accordance with claim 12 in which the silicone edge sealant is a room temperature vulcanizable silicone sealant composition.

14. The sealed insulating glass unit in accordance with claim 13 in which the room temperature vulcanizable silicone edge sealant composition is void of at least one ingredient selected from the group consisting of a plasticizer and a bond rearranging ingredient which remains active after the silicone sealant has cured.

* * * * *